United States Patent [19]

Heroguelle

[11] Patent Number: 4,643,819

[45] Date of Patent: Feb. 17, 1987

[54] DEVICES FOR THE GALVANIC RECOVERY OF METALS FROM DILUTED SOLUTIONS

[76] Inventor: Yves Heroguelle, 3 Place Toulouse Lautrec, 51100 Reims, France

[21] Appl. No.: 689,855

[22] Filed: Jan. 9, 1985

[30] Foreign Application Priority Data

Jan. 9, 1984 [FR] France ..... 84 00203
Dec. 13, 1984 [FR] France ..... 84 18992

[51] Int. Cl.[4] ..... C25C 7/00; C25B 11/03; C25B 11/04; C25B 7/02

[52] U.S. Cl. ..... 204/269; 204/272; 204/275; 204/284; 204/286; 204/292

[58] Field of Search ..... 204/260, 272, 269, 275, 204/290 R, 286, 284, 292

[56] References Cited

U.S. PATENT DOCUMENTS

| | | | |
|---|---|---|---|
| 3,573,178 | 3/1971 | Blackmar | 204/272 X |
| 3,859,195 | 1/1975 | Williams | 204/272 |
| 3,923,629 | 12/1975 | Shaffer | 204/272 X |
| 3,984,303 | 10/1976 | Peters et al. | 204/272 X |
| 4,040,938 | 8/1977 | Robertson | 204/272 X |
| 4,202,739 | 5/1980 | Csakvary et al. | 204/284 X |
| 4,276,147 | 6/1981 | Epner et al. | 204/272 |
| 4,367,127 | 1/1983 | Messing et al. | 204/272 X |
| 4,515,672 | 5/1985 | Platek et al. | 204/275 X |
| 4,585,539 | 4/1986 | Edson | 204/260 X |

*Primary Examiner*—Donald R. Valentine
*Attorney, Agent, or Firm*—Darby & Darby

[57] ABSTRACT

This invention relates to a device for the galvanic recovery of metals from a diluted solution by means of permeable electrodes through which the diluted solution is caused to flow, said electrodes being molten after having been coated with metal. The cathode (6) is made of a very fine metal lattice having no mechanical strength of its own which is stiffened by an inert support formed of plastic netting, said cathode being crossed perpendicularly by the diluted solution flowing therethrough.

14 Claims, 9 Drawing Figures

DEVICES FOR THE GALVANIC RECOVERY OF METALS FROM DILUTED SOLUTIONS

This invention relates to a device designed for the galvanic recovery of metals from diluted solutions, such as for instance washing baths in an electroplating plant.

Such an electroplating plant always comprises, in addition to the actual electrolytic baths, washing baths in which are dipped the items coming out of the electrolytic baths; in the long run, these washing baths become increasingly enriched with dissolved metal, so that it is worthwhile to recover this metal. A method is known for carrying out this recovery by electrolysis using a porous cathode through which flows the bath out of which it is desired to extract the metal. Thus, the metal becomes deposited on the walls of the porous cathode, which is subsequently molten.

BACKGROUND OF THE INVENTION

More particularly, a process is known in which use is made of polyester foam sponges having open cells, the surface of which has been metallized beforehand, so that they are rendered conductive. The liquid containing dissolved metal is then caused to flow through these sponges which are used as the cathode. The metal becomes deposited on the walls of these sponges which are subsequently coarsely crushed and heated to a high temperature. The plastic material will then become gasified away while the recovered metal is molten and mixes with the metal which was initially coating the walls of the sponge cells.

However, it will often be found that the products in which the metal is dissolved, such as cyanide, for instance, remove the metal coating from the central part of the sponge before the metal which is to be recovered has had enough time to form a deposit. Thus, only the exterior layers of the sponges remain conductive. In this case, the yield of the recovery system is quite poor.

It is an object of this invention to provide improvements in devices of the above-mentioned type, for overcoming the above stated drawbacks.

SUMMARY OF THE INVENTION

According to this invention, a device is provided for the electrolytic recovery of metals from diluted solutions by means of porous cathodes through which a diluted solution is caused to flow, this device being characterized by the cathode being formed of a fine wire mesh carried by an insulating support perforated with a large number of holes, and by this cathode being arranged in such manner that the solution will flow through it along a direction substantially perpendicular to the surface of said cathode.

According to a first embodiment of this invention, the recovery device may be formed of a cylindrical tank inside which are placed two coaxial anodes, namely a central anode and a peripheral one, between which is placed a cathode formed of a fine metal wire mesh resting against a plastic netting, the solution feed being alongside the outer anode and the evacuation of the solution being through the central part of the tank.

Preferably, the cathode has the shape of a hollow cylinder formed by spirally winding together a sheet of fine copper wire mesh resting against a wide-mesh plastic netting. The diameter of the copper wire may be comprised between 1/10 and 4/10 mm and the diameter of the yarn forming the plastic netting is approximately 1.5 mm.

According to another embodiment of the invention, the device may be formed of an elongated tank provided at one end with an inlet for the solution and at the other end with an outlet, said tank containing a plurality of alternatively positive and negative electrodes, these electrodes being made of a fine wire mesh carried on a plastic netting and being placed across the flowing direction of the solution.

In this embodiment, a cathodes may advantageously be formed of mats comprising several layers of fine wire mesh held between plastic nettings, and the cathode may be placed between non-permeable anodes arranged in alternate staggered positions.

The invention will now be described in detail, with reference to the appended drawings, in which:

FIG. 1 is a diagrammatic plane view, cut-out in part, of a first embodiment of the invention, FIG. 2 is a diagrammatic plane view of a second embodiment, FIG. 3 is a diagrammatic plane view showing a recovery plant comprising a tank similar to the one of FIG. 1, FIG. 4 is a large-scale perspective view of a modified embodiment, FIG. 5 is a perspective view of a hollow cylindrical cathode formed by a spiral winding operation, FIG. 6 shows in perspective a connecting ring to be used with the cathode of FIG. 5, FIG. 7 is a diagrammatic view, at a very large scale, showing deposits of metal on the cathode wires, FIG. 8 is a diagrammatic elevation view of a device according to FIG. 2, provided with cathodes having a quilted structure, FIG. 9 is a comparative circuit illustrating the efficiency of a cathode according to FIG. 1.

DETAILED DESCRIPTION OF THE INVENTION

Figure 1:
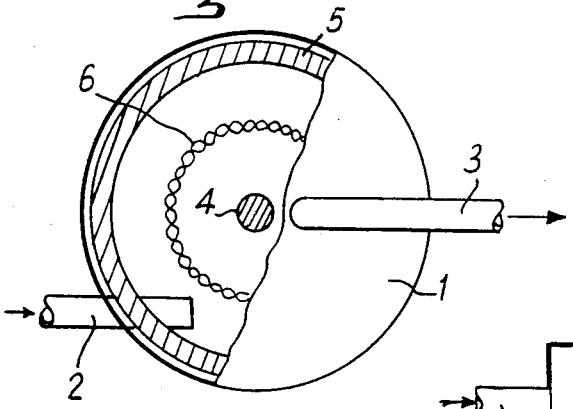

Referring to FIG. 1, a first example is shown in which the galvanic recovery tank is a cylindrical tank 1 provided with a feed pipe 2 which is preferably tangential and a delivery pipe 3. Inside this tank are located three electrodes, namely a central anode 4, a peripheral cylindrical anode 5 and a cathode 6 placed between the two anodes 4 and 5. The feed pipe 2 opens inside the peripheral anode 5, so that the solution will need to flow only through the cathode 6, which is the only electrode needing to be permeable, whereas the anodes 4 and 5 do not need to be permeable. Cathode 6 is formed of a fine metal mesh, for instance with latticed copper wire having a diameter of the order of 1/10 mm. Since this lattice offers no mechanical strength, it needs to be stiffened by an inert support which may advantageously be formed of a plastic netting, or any other insulating material being sufficiently porous for allowing an easy flow of the solution while being sufficiently stiff for maintaining the metal mesh in proper shape.

On another hand, it will be possible to use, instead of a meshed metal wire, any other structure such as a woven or extruded one, or also expanded metal.

It will also be possible to use more than two coaxial electrodes, but in this case at least the intermediary electrodes will need to be permeable. In this case, they may have a structure similar to the cathode 6, but since they are not expected to collect any metal deposit, they may be made of a self-supporting netting. In this case, use can advantageously be made of these self-supporting anodes as supports for the lattice of the cathodes which needs to be as fine as possible and is therefore not self-supporting. It will then be necessary to interpose between the carrying metallic anode and the cathode lattice some insulating connection means.

Figure 5:
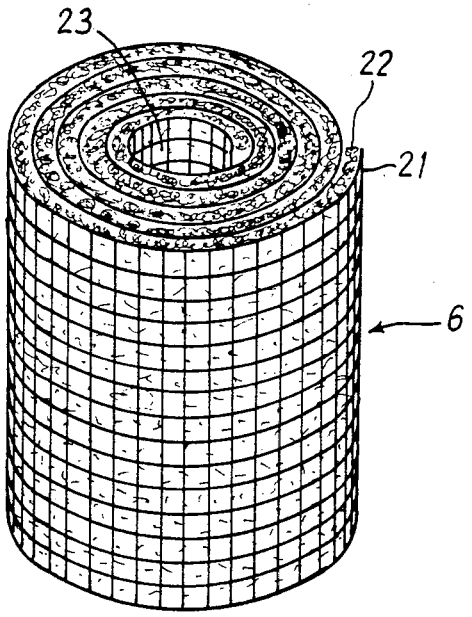

FIG. 5 shows the cylindrical cathode 6 which is made by spirally winding a metal lattice which has no mechanical stiffness and must therefore be kept in shape by a plastic netting.

For making this cathode 6, a strip 21 of relatively thick (about 1.5 mm) plastic netting having a width of about 250 mm and a length of about 7 meters is laid flat; over this strip is placed a metallic strip 22 formed of one or several layers of knitted copper wire having a diameter comprised between 1/10 and 4/10 millimeters, this strip having the same length and width as the plastic netting, and both strips are then spirally wound together so as to obtain a tubular roll having a cylindrical orifice 23 in its central part. Thanks to the plastic netting spiral, this hollow cylinder has an excellent mechanical strength, as it comprises between the spiral loops of this netting a sort of continuous metallic mat made of very fine wire. Thus, the solution will flow very easily perpendicularly across the cathode while a large contact surface is available.

This cylindrical cathode is then placed inside the apparatus described in reference to FIG. 1, meaning that it is inserted within a cylindrical surrounding anode 5, while the central anode 4 fits inside the central cavity 23 of cathode 6.

Figure 6:
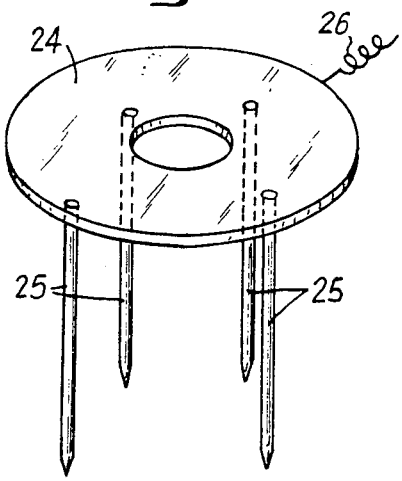

Referring to FIG. 6, it will be seen that the electrical connecting member of the cathode 6 of FIG. 1 is composed of a metal crown 24 having the same external and internal diameters as the cathode 6. To this crown are attached a number of conductive needles 25 which are distributed at various distances around the center of the crown 24, so that electrical current may be fed throughout the bulk of the cathode. The crown 24 is connected to a current feed line 26.

There is thus obtained a cathode having outstanding qualities, since there has been obtained, with a cathode containing 220 g of copper, a silver deposit of such size that, at the end of the recovery operation, the weight of this cathode was 4,820 g, that is 4600 g silver. By melting down this cathode, 95.43% pure silver was obtained. In this test, the final silver contents of the electrolyte was as low as 2 ppm. During the melting operation, the plastic material was burnt off without mixing with the metal.

Figure 9:
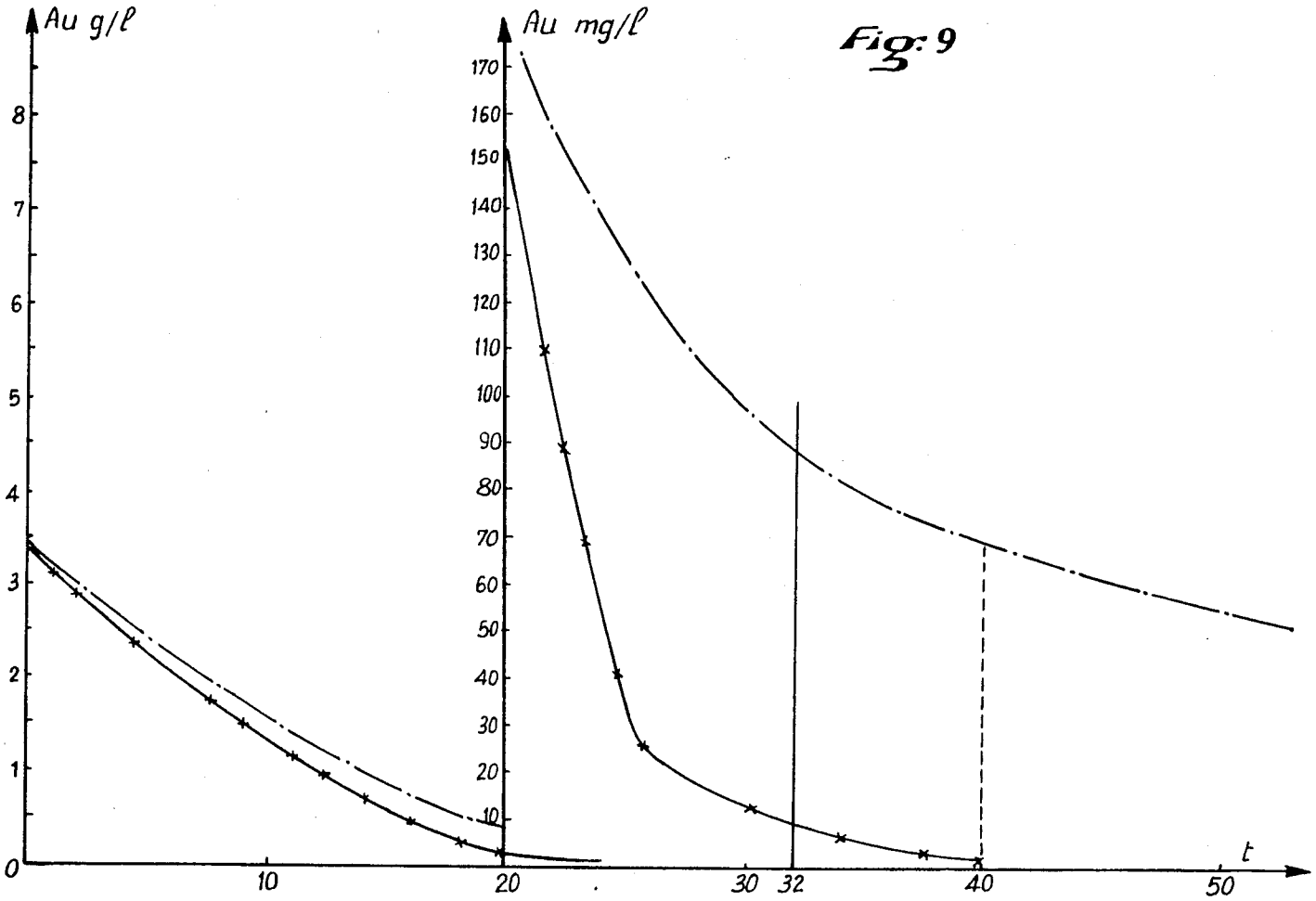

FIG. 9 represents the curve of decrease of the gold contents in a solution purified with a device according to this invention. In this test, the gold bath has a pH of 8.0, a volume of 123 liters, an initial concentration of 3.3 g/liter, while the pumping rate was 550 liters/hr and the current was 8 amperes. The curve shown in full line relates to the apparatus of this invention, whereas the dotted curve relates to a known apparatus having a porous cathode made of polyester foam.

The first 20 hours phase shows that the operation of both devices is more or less similar; only after 20 hours of operation, when the bath concentration becomes low, that is less than 200 mg/liter, will it be seen that the difference becomes quite substantial, since a content of 2 mg/liter was reached after a total of 40 hours with the device of the invention, whereas this content was still approximately 70 mg/liter after the same 40 hours period with the prior known device.

Figure 7:
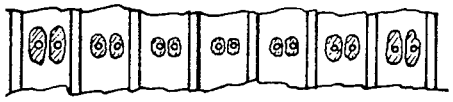

On another hand, it has been found in practice that, owing probably to an effect which is similar to the one known to specialists as the "masked cathode effect", the various inert netting layers enclosed within the mass of the electrode act as a mask and enhance the depositing of metal within the core of the electrode, as shown diagrammatically on FIG. 7, whereas with prior cathodes, even porous ones, depositing occurred only on the outer walls of the cathode.

Figure 2:
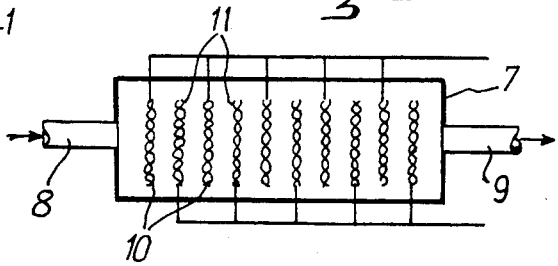

Referring now to FIG. 2, a second example of embodiment is shown, in which the tank is an elongated enclosure 7 of parallelepiped shape provided at one end with a solution feed pipe 8 and at the opposite end with an outlet pipe 9. Between these two ends are placed several planar permeable electrodes across which the liquid will flow perpendicularly as it flows from inlet 8 to outlet 9, these electrodes being alternatively anodes 10 and cathodes 11.

Figure 8:
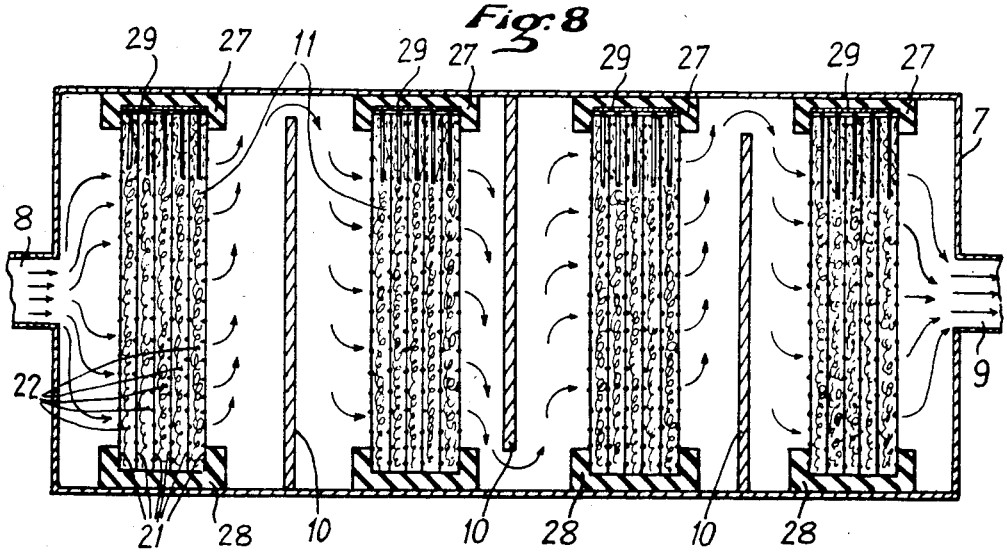

According to a modified embodiment shown on FIG. 8, the anodes 10 are impervious and are staggered so as to leave passages **10*a* and 10*b* located alternatively along the top and bottom of enclosure 7 so as to force the liquid to follow a winding path. On the contrary, the cathodes 11 are permeable and the solution flows perpendicularly across them, as shown by FIG. 8. Similarly to what is shown in FIG. 5, each of the cathodes 11 is formed of layered strips of copper wire mesh, the diameter of the wire being comprised between 1/10 and 4/10 mm while these layers are confined between plastic grids 21**.

Preferably also, the various grids 21 between which are confined the layers 22 of copper wire mesh are held by upper supports 27 and lower supports 28 made of non-conductive material, within which are embedded conductive metal blades 29. Each blade 29 is bound up with several metal needles 30 which extend into the various layers 22 of copper wire mesh. Also, each blade 29 protrudes outside of the enclosure 7 on one of the sides and the protruding ends of all these blades are electrically connected to a common current feed busbar.

Figure 4:
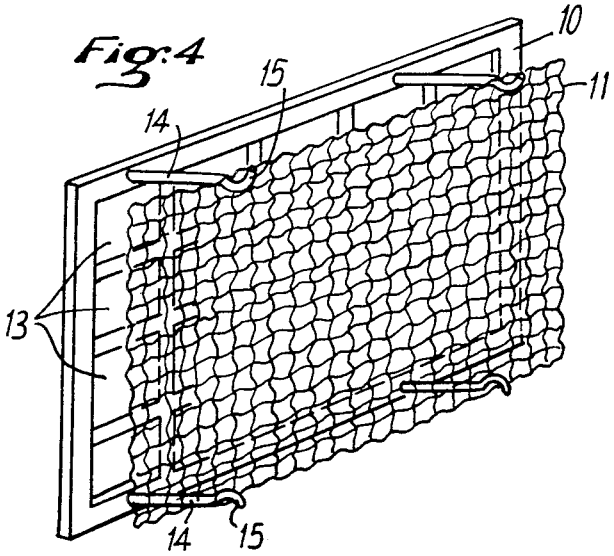

Referring to FIG. 4, it can be seen that the anodes 10 may be made of metal with sufficient thickness for being self-supporting, such as for instance a metal plate in which will have been punched, by stamping or otherwise, a multitude of orifices 13. To this perforated plate are fixed a plurality of insulating supports 14 which are, in the example shown, horizontal rods ending with hooks 15. These rods 14 and their hooks 15 serve for holding tight a fine wire mesh 11 forming the cathode.

Figure 3:
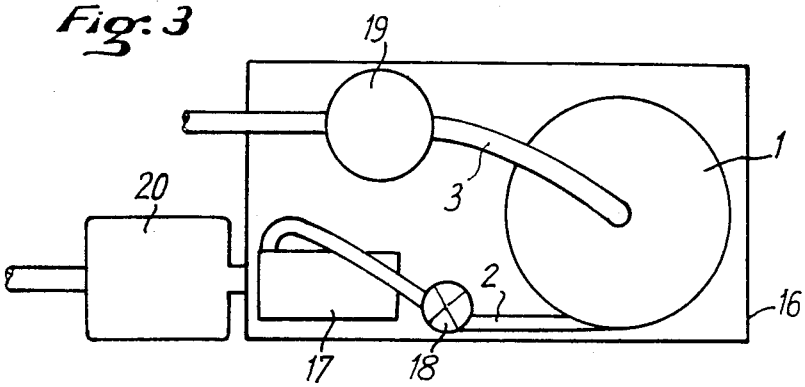

FIG. 3 shows a complete galvanic recovery installation comprising: a frame 16 within which are arranged a pump 17, a valve 18, the tank 1 of FIG. 1, a filter 19 on the outlet pipe 3 and a priming tank 20 located upstream of the pump 17.

Quite obviously, the devices according to this invention are not limitatively intended for the recovery of diluted metal from the washing tanks of electroplating installations, but they may also be used for any galvanic recovery operation with diluted metals in solutions, for instance from developing baths for radiographic negatives and also from any electrolytic baths, such as for the purpose of purifying residual waters so as to comply with the rules on the concentration of heavy metals prior to discharge.

Thanks to the described arrangements, owing to the fact that the cathode(s) are made of very fine wire, the tritration of the recovered metal, after the melt-down, is very high because it comprises only a small proportion of the metal from which the cathode was made.

What is claimed is:

1. A device for the galvanic recovery of metals from a diluted solution by means of permeable electrodes through which the diluted solution is caused to flow, comprising at least one impervious anode through which said solution cannot flow and at least one cathode formed of very fine wire mesh having front and rear surfaces and offering no mechanical resistance of its own and being stiffened by an inert support made up of plastic netting, the diluted solution flowing through said cathode so as to pass between said front and rear surfaces and traversing the entire cathode before encountering another electrode.

2. A device according to claim 1, characterized in that it comprises a cathode made up by cylindrically wrapping around a sheet formed of a strip of plastic netting made of relatively thick strands and of a strip made of several layers of knitted copper wire mesh.

3. A device for the galvanic recovery of metals from a diluted solution by means of permeable electrodes through which the diluted solution is caused to flow, comprising a cathode formed of very fine wire mesh having front and rear surfaces and offering no mechanical resistance of its own and being stiffened by an inert support made up of plastic netting, the diluted solution flowing through said cathode so as to pass between said front and rear surfaces and traversing the entire cathode before encountering another electrode wherein the cathode is formed as a permeable hollow cylindrical cathode, and the device further comprises an impervious anode placed inside this cathode and an impervious anode placed around said cathode.

4. A device according to claim 3, characterized in that it comprises a cathode made up by cylindrically wrapping around a sheet formed of, a strip of plastic netting made of relatively thick strands and of a strip made of several layers of knitted copper wire mesh.

5. A device for the galvanic recovery of metals from a diluted solution by means of permeable electrodes through which the diluted solution is caused to flow, characterized by the cathode being formed of very fine wire mesh offering no mechanical resistance of its own and being stiffened by an inert support made up of plastic netting, this cathode being crossed perpendicularly by the diluted solution flowing therethrough, the cathode being made up by cylindrically wrapping around a sheet formed of a strip of plastic netting made of relatively thick strands and of a strip made of several layers of knitted copper wire mesh, wherein the diameter of the knitted copper wire is comprised between 1/10 and 4/10 mm while the diameter of the strands of the plastic netting is approximately 1.5 mm.

6. A device for the galvanic recovery of metals from a diluted solution by means of permeable electrodes through which the diluted solution is caused to flow, characterized by the cathode being formed of very fine wire mesh offering no mechanical resistance of its own and being stiffened by an inert support made up of plastic netting, this cathode being crossed perpendicularly by the diluted solution flowing therethrough, the cathode being made up by cylindrically wrapping around a sheet formed of a strip of plastic netting made of relatively thick strands and of a strip made of several layers of knitted copper wire mesh, wherein the cylindrical cathode presents a central cylindrical hole so that said tubular cathode may be slipped over a central anode and inside a peripheral anode.

7. A device according to claim 6, in which the diluted solution is fed into the tank by a tangential pipe and is discharged through a central pipe.

8. A device according to claim 6 in which the diameter of the knitted copper wire is comprised between 1/10 and 4/10 mm while the diameter of the strands of the plastic netting is approximately 1.5 mm.

9. A device for the galvanic recovery of metals from a diluted solution by means of permeable electrodes through which the diluted solution is caused to flow, characterized by the cathode being formed of very fine wire mesh offering no mechanical resistance of its own and being stiffened by an inert support made up of plastic netting, this cathode being crossed perpendicularly by the diluted solution flowing therethrough, the device further comprising a parallelepipedic tank in which are alternatively arranged a plurality of planar anodes and planar cathodes parallel to each other, said tank being provided on one end with a feed pipe and on the other end with a discharge pipe.

10. A device according to claim 9, characterized in that it comprises a series of impervious anodes placed in staggered arrangement between which are placed permeable cathodes crossed perpendicularly by the solution, these cathodes being formed by strata of plastic netting between which are confined layers of knitted copper wire mesh.

11. A device according to claim 10, in which the sets of plastic nets and knitted copper wire strips are held together by upper supports and lower supports, the upper supports containing conductive blades connected to a common current feed busbar.

12. A device according to claim 9, in which the support comprises a conductive metal plate forming an anode and carrying the fine metal lattice which constitutes the cathode by means of a series of insulating supports.

13. A device according to any one of claims 5, 6 or 9 further comprising a permeable hollow cylindrical cathode, an impervious anode placed inside this cathode and an impervious anode placed around said cathode.

14. A device according to claim 9 further comprising a cathode made up by cylindrically wrapping around a sheet formed of a strip of plastic netting made of relatively thick strands and of a strip made of several layers of knitted copper wire mesh.

* * * * *